US008047525B2

(12) United States Patent
Taki et al.

(10) Patent No.: US 8,047,525 B2
(45) Date of Patent: Nov. 1, 2011

(54) FINISHER, SHEET DISCHARGING METHOD AND IMAGE FORMING APPARATUS

(75) Inventors: Hiroyuki Taki, Shizuoka-Ken (JP); Katsuya Sasahara, Shizuoka-Ken (JP); Hiroyuki Tsuchihashi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 249 days.

(21) Appl. No.: 12/366,494

(22) Filed: Feb. 5, 2009

(65) Prior Publication Data

US 2009/0200726 A1 Aug. 13, 2009

Related U.S. Application Data

(60) Provisional application No. 61/027,139, filed on Feb. 8, 2008, provisional application No. 61/028,448, filed on Feb. 13, 2008, provisional application No. 61/073,022, filed on Jun. 16, 2008.

(51) Int. Cl.
*B65H 39/00* (2006.01)

(52) U.S. Cl. ..... 270/58.17; 270/58.07; 270/58.11; 270/58.12; 270/58.27

(58) Field of Classification Search ..... 270/58.07, 270/58.08, 58.09, 58.11, 58.12, 58.17, 58.16, 270/58.27

See application file for complete search history.

(56) References Cited

U.S. PATENT DOCUMENTS

| | | | | |
|---|---|---|---|---|
| 5,852,764 | A | 12/1998 | Kida et al. | |
| 7,007,948 | B2 * | 3/2006 | Kamiya et al. | 271/221 |
| 7,172,186 | B2 * | 2/2007 | Saito et al. | 270/58.08 |
| 7,264,236 | B2 * | 9/2007 | Obuchi et al. | 270/37 |
| 2002/0063380 | A1 | 5/2002 | Tamura et al. | |
| 2002/0158405 | A1 | 10/2002 | Nagasako et al. | |

FOREIGN PATENT DOCUMENTS

| | | | |
|---|---|---|---|
| JP | 2005-111693 | A | 4/2005 |
| JP | 2005-345663 | A | 12/2005 |
| JP | 2008-023985 | A | 2/2008 |

* cited by examiner

*Primary Examiner* — Leslie A Nicholson, III
(74) *Attorney, Agent, or Firm* — Patterson & Sheridan, LLP

(57) ABSTRACT

A conveying unit has a nipping hook to nip a sheet bundle and conveys the sheet bundle while nipping the sheet bundle with the nipping hook. A discharge roller sequentially discharges the sheet bundle conveyed by the conveying unit. A stack unit stacks the sheet bundle conveyed by the conveying unit. A shutter is provided between the discharge roller and the stack unit. A push-out lever is fixed to the discharge roller. An opening is provided on one side of the shutter, and a push-out part which causes the push-out lever to protrude to the stack unit from the opening of the shutter with a rotation of the nipping pawl is provided on the nipping hook. The push-out lever caused to protrude to the stack unit by the push-out part pushes out the sheet bundle to the stack unit in accordance with the rotation of the nipping hook.

8 Claims, 17 Drawing Sheets

FINISHER, SHEET DISCHARGING METHOD AND IMAGE FORMING APPARATUS

CROSS-REFERENCE TO RELATED APPLICATIONS

This application is based upon and claims the benefit of priority from: U.S. provisional application No. 61/027,139, filed on Feb. 8, 2008; U.S. provisional application No. 61/028,448, filed on Feb. 13, 2008; and U.S. provisional application No. 61/073,022, filed on Jun. 16, 2008, the entire contents of each of which are incorporated herein by reference.

TECHNICAL FIELD

Described herein relates to a finisher, a sheet discharging method and an image forming apparatus, and particularly to a finisher, a sheet discharging method and an image forming apparatus that can prevent sheet jam due to a bundle hook.

BACKGROUND

Recently, an electrographic image forming apparatus such as a laser printer, digital copy machine or laser facsimile is provided with a post-processing device (finisher) that staples a sheet bundle. The conventional finisher discharges a sheet bundle by using a roller and a bundle hook.

However, if the finisher discharges a sheet bundle by using the bundle hook, the rear end of the sheet bundle may not properly fall into a paper discharge tray because of the influence of the coefficient of friction of the sheets, of elasticity (strength) of the sheet bundle, and of the quantity of electricity with which the sheet bundle is charged. The insufficiently falling sheet bundle may be hooked by the bundle hook. This causes a problem of sheet jam.

SUMMARY

A finisher described herein includes: a conveying unit having a nipping hook to nip a sheet bundle configured to convey the sheet bundle while nipping the sheet bundle with the nipping hook; a discharge unit configured to sequentially discharge the sheet bundle conveyed by the conveying unit; a stack unit configured to stack the sheet bundle conveyed by the conveying unit; a shutter having an opening provided on one side of the shutter configured to be provided between the discharge unit and the stack unit; a push-out lever fixed to the discharge unit configured to push out the sheet bundle to the sheet unit; and a push-out part provided on the nipping hook configured to protrude the push-out lever to the stack unit from the opening of the shutter, with a rotation of the nipping hook.

A sheet discharging method described herein includes: a conveying unit having a nipping hook to nip a sheet bundle which conveys the sheet bundle while nipping the sheet bundle; a discharge unit which sequentially discharges the sheet bundle conveyed by the conveying unit; a stack unit which stacks the sheet bundle conveyed by the conveying unit; a shutter provided between the discharge unit and the stack unit; a push-out lever fixed to the discharge unit; and a push-out part provided on the nipping hook which protrudes the push-out lever to the stack unit from an opening of the shutter with a rotation of the nipping hook, the method comprising pushing out the sheet bundle to the stack unit by the push-out lever protruded to the stack unit by the push-out part in accordance with the rotation of the nipping hook.

An image forming apparatus described herein includes: a conveying unit having a nipping hook to nip a sheet bundle configured to convey the sheet bundle while nipping the sheet bundle with the nipping hook; a discharge unit configured to sequentially discharge the sheet bundle conveyed by the conveying unit; a stack unit configured to stack the sheet bundle conveyed by the conveying unit; a shutter having an opening provided on one side of the shutter configured to be provided between the discharge unit and the stack unit; a push-out lever fixed to the discharge unit configured to push out the sheet bundle to the sheet unit; and a push-out part provided on the nipping hook configured to protrude the push-out lever to the stack unit from the opening of the shutter, with a rotation of the nipping hook.

DESCRIPTION OF THE DRAWINGS

In the attached drawings.

DETAILED DESCRIPTION

First Embodiment

Figure 1:
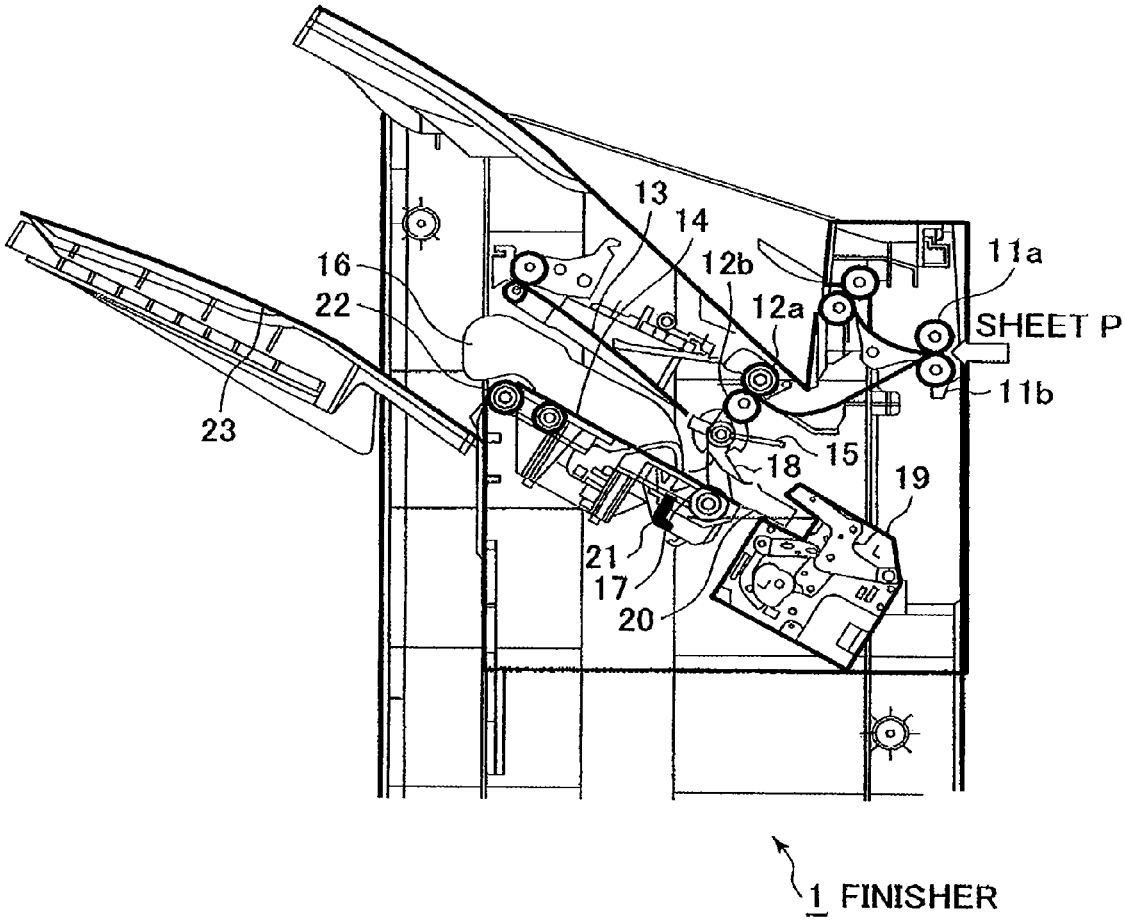
FIG. 1 shows a configuration of a finisher according to an embodiment.

FIG. 1 shows a configuration of a finisher (post-processing device) 1 according to this embodiment. The finisher 1 is provided in an image forming apparatus. Entry rollers 11*a* and 11*b* form a pair of rollers and receive a sheet P supplied from an image forming unit provided outside the finisher 1. The entry rollers 11*a* and 11*b* carry the received sheet P to exit rollers 12*a* and 12*b*. A standby tray 13 temporarily holds the sheet P carried from the exit rollers 12*a* and 12*b*. The finisher 1 opens the standby tray 13 and supplies the temporarily held sheet P by dropping the sheet P onto a processing tray 14. A sheet guide 18 guides the rear end of the sheet P supplied to the processing tray 14, to a stapler 19. A lateral alignment board 16 laterally aligns the sheet P on the processing tray 14. A paddle 15 and a longitudinal alignment roller 17 abut the rear end of the sheet P on the processing tray 14 to a rear stopper 26 and thus longitudinally align the sheet P.

Figure 2:
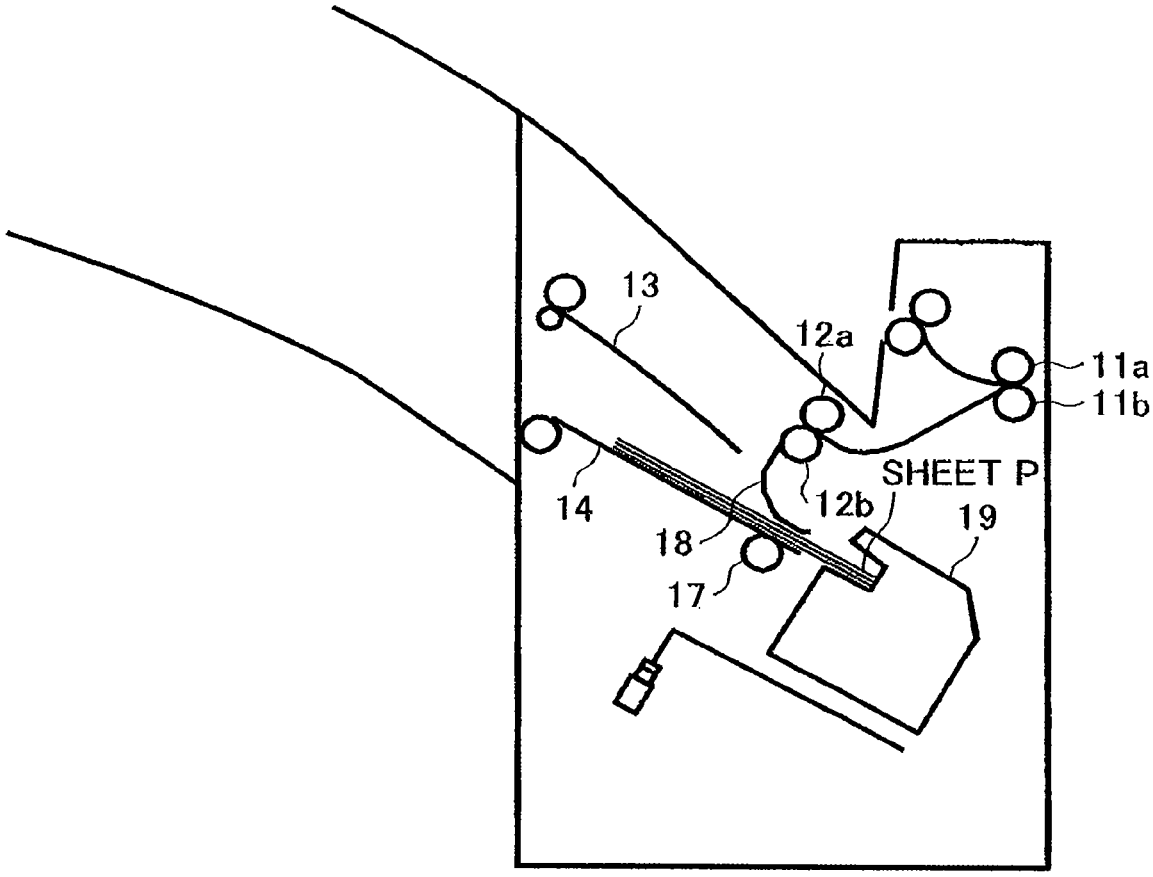
FIG. 2 shows the state where a sheet bundle is sequentially guided to a processing tray via a standby tray and is then guided to a stapler.

As shown in FIG. 2, the sheet P is sequentially guided to the processing tray 14 via the standby tray 13 and is then guided to the stapler 19 through the above process. The sheet guide 18 moves to expand its gap from the processing tray 14. As the sheet P of the last page is guided to the stapler 19, the stapler 19 staples a sheet bundle of the guided sheets P. An ejector 20 has an eject arm. The ejector 20 pushes out the sheet bundle that is stapled by the stapler 19 into the direction of a stack tray 23 and delivers the sheet bundle over to a bundle hook belt 21. The bundle hook belt 21 has the sheet bundle hooked by a bundle hook 21*a* provided on the bundle hook belt 21 and discharges the sheet bundle to the stack tray 23, interlocked with discharging by a discharge roller 22. A bundle hook motor for driving the bundle hook belt 21 drives the ejector 20 via an electromagnetic spring clutch. The electromagnetic spring clutch transmits a driving force of the bundle hook motor to the ejector 20 by turning on the electromagnetic spring clutch.

Figure 3:
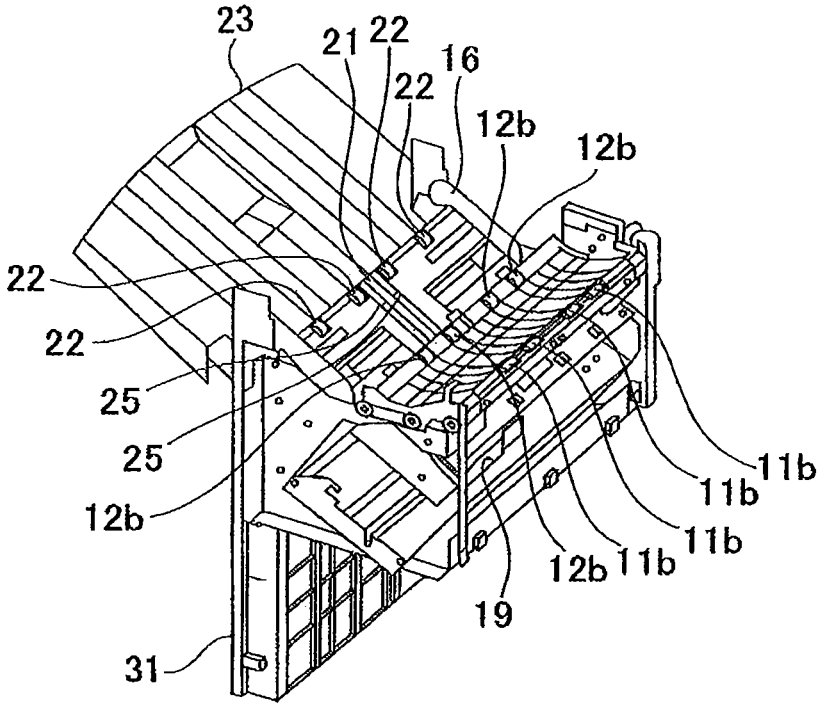
FIG. 3 is a perspective view of the finisher shown in FIG. 1.
Figure 4:
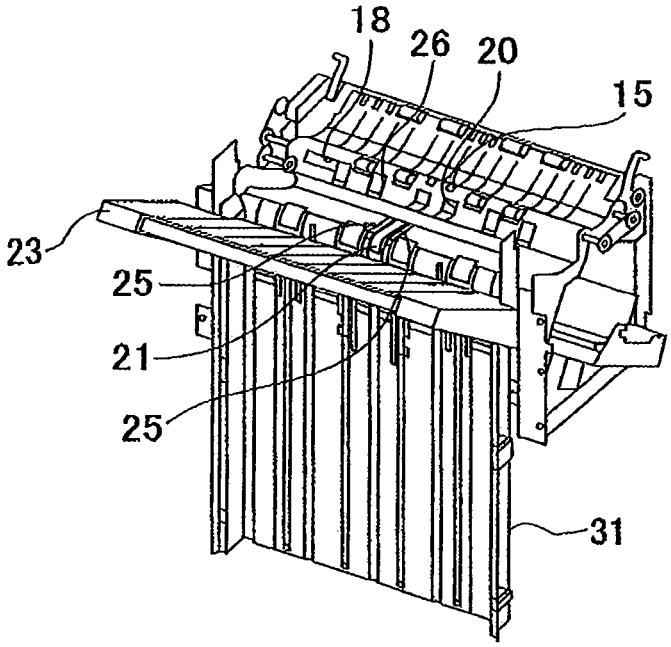
FIG. 4 is another perspective view of the finisher shown in FIG. 1.
Figure 5:
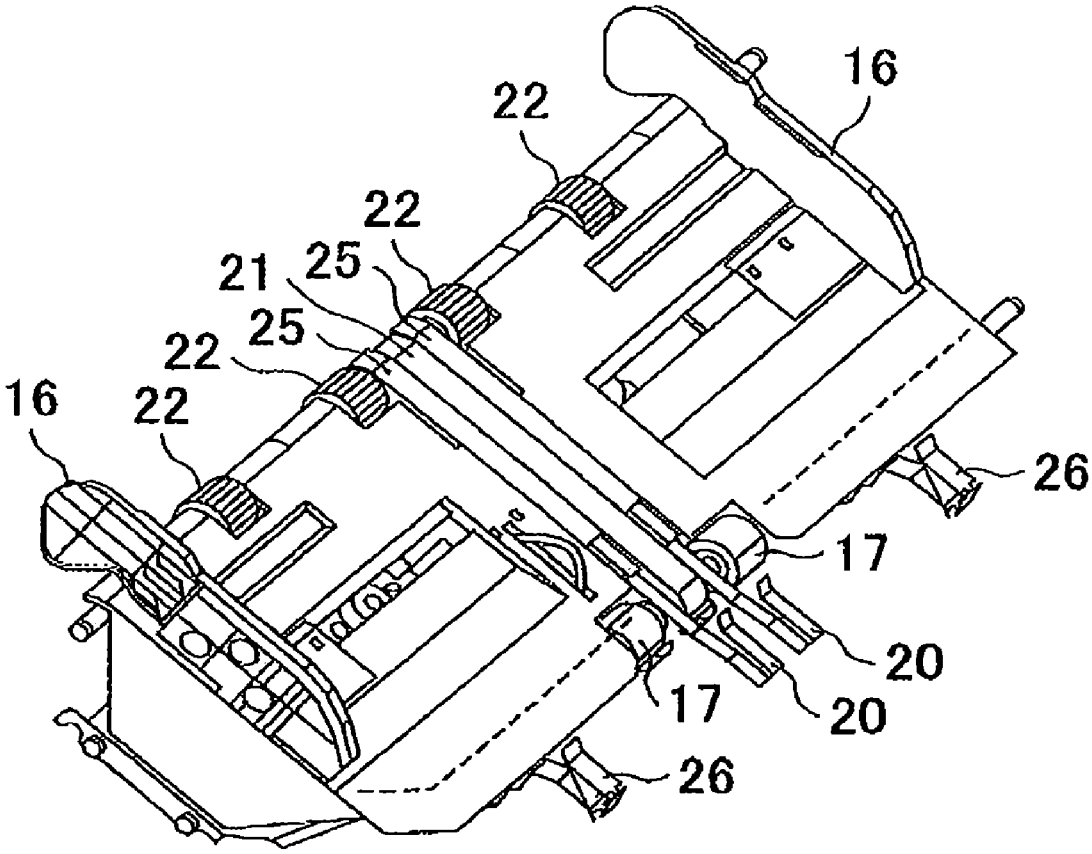
FIG. 5 is still another perspective view of the finisher shown in FIG. 1.
Figure 6:
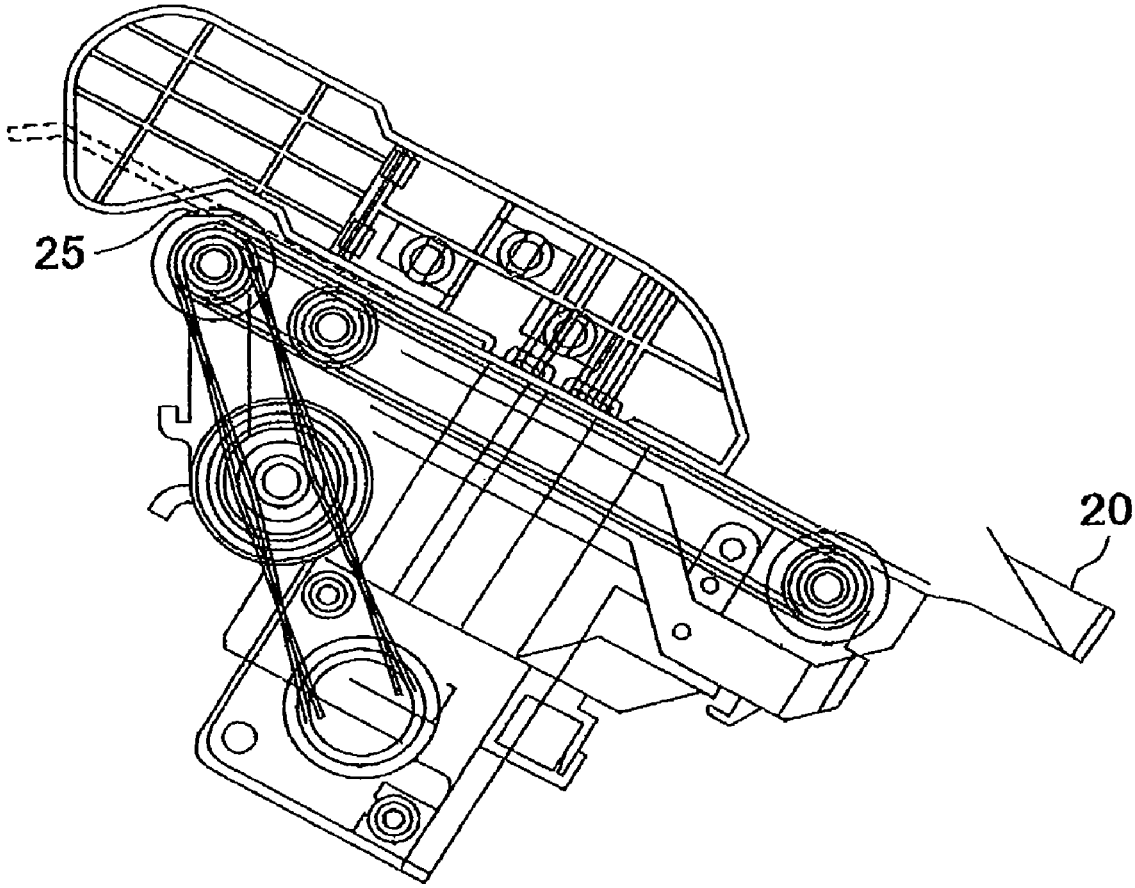
FIG. 6 is a sectional view of the finisher shown in FIG. 1.
Figure 7:
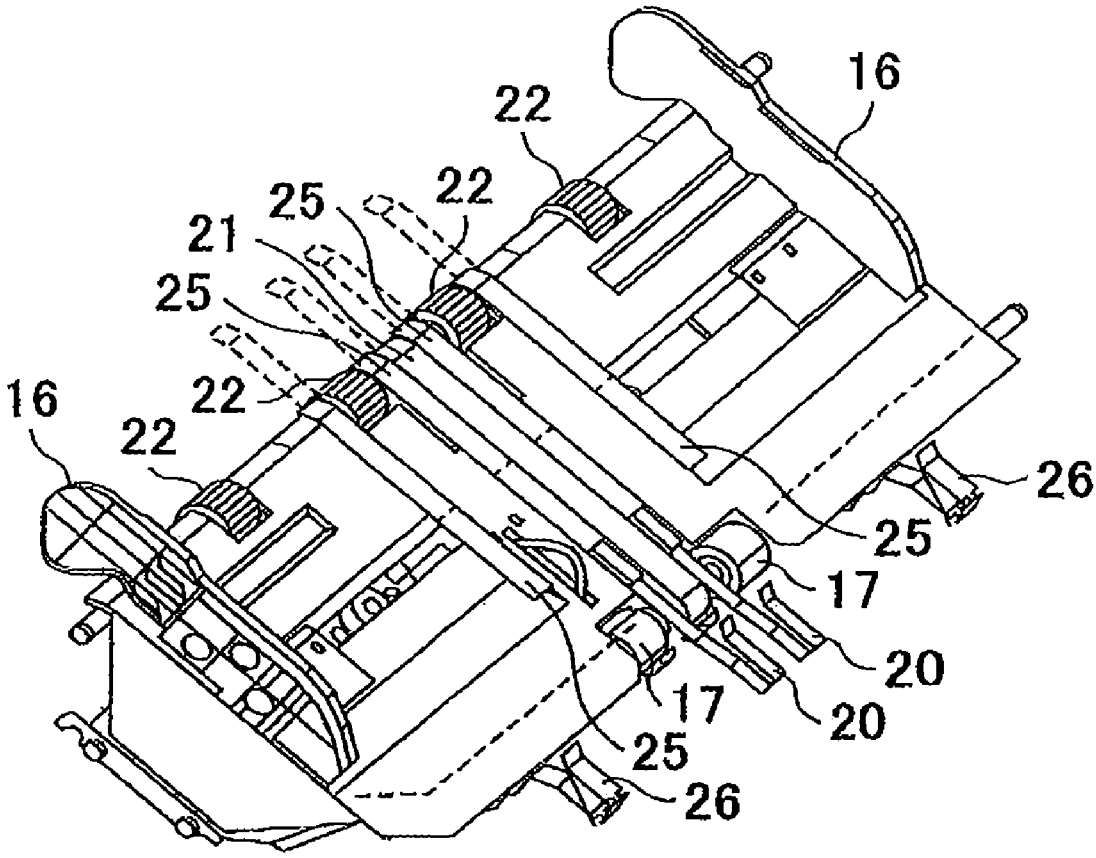
FIG. 7 is another perspective view of the finisher shown in FIG. 1.

FIG. 3 to FIG. 5 are perspective views of the finisher 1. Thruster bars 25 are formed integrally with the ejector 20 and have a resin boned to their distal ends. FIG. 6 is a sectional view of the finisher 1. FIG. 7 is a perspective view of a finisher 1 having four thruster bars 25, which is different from the finisher having two thruster bars 25 shown in FIG. 2 to FIG. 5.

Figure 8:
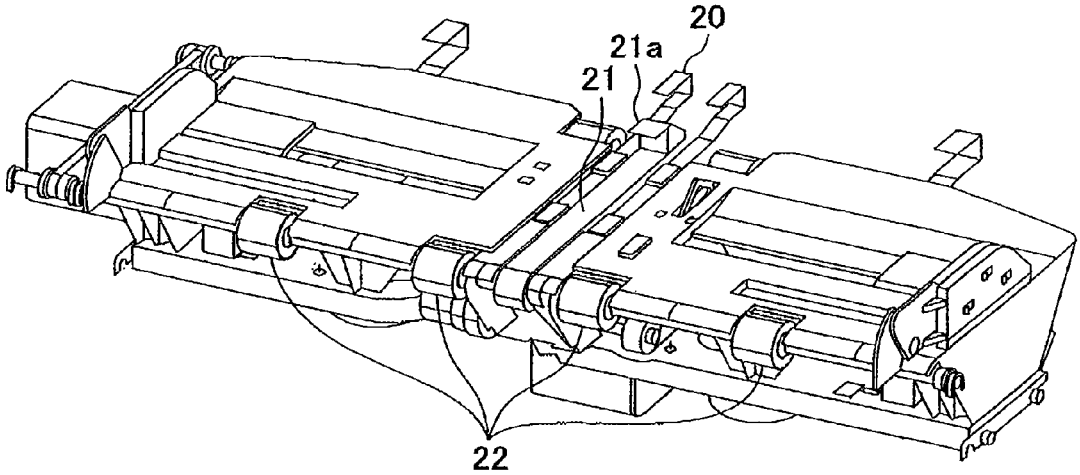
FIG. 8 is an explanatory view for explaining discharge of a sheet bundle in the finisher.
Figure 9A:
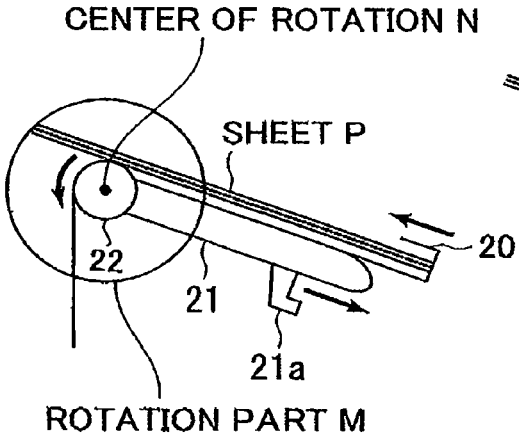
FIG. 9A and FIG. 9B are explanatory views for explaining discharge of a sheet bundle in the finisher.
Figure 9B:
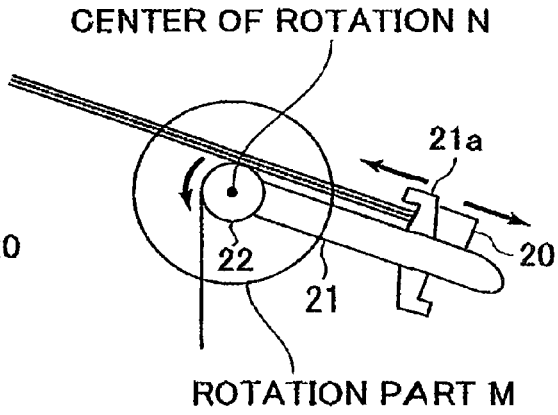

Discharging of a sheet bundle in the finisher 1 will be described with reference to FIG. 8, FIG. 9A and FIG. 9B. If binding of a sheet bundle is completed, the ejector 20 is driven by the transmission of driving as the electromagnetic spring clutch is turned on. Also, the bundle hook belt 21 and the discharge roller 22 are driven substantially simultaneously. As shown in FIG. 9A and FIG. 9B, the bundle hook 21*a* on the bundle hook belt 21 overtakes the ejector 20 and receives the sheet bundle from the ejector 20. Then, the bundle hook 21*a* hooks the sheet bundle and discharges the sheet bundle to the stack tray 23, interlocked with discharging by the discharge roller 22. The bundle hook 21*a* moves along a curved track that is away from the center of rotation N by a distance r, in order to return to its home position after discharging the sheet bundle. The part where the bundle hook 21*a* rotates in this manner is defined as a "rotation part M".

Figure 10:
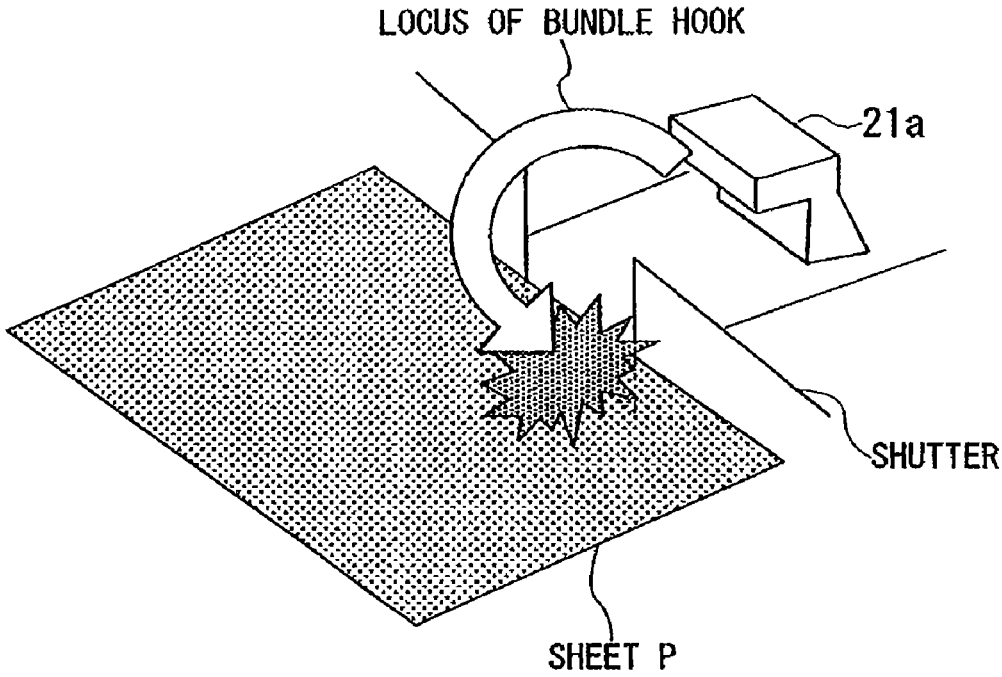
FIG. 10 shows the state where an insufficiently falling sheet bundle is hooked by a bundle hook, thereby causing sheet jam.

Conventionally, when the finisher 1 discharges a sheet bundle to the stack tray 23 by using the bundle hook 21*a*, the rear end of the sheet bundle does not properly fall into the stack tray 23 because of the influence of the coefficient of friction of sheets, the elasticity (strength) of the sheet bundle and the quantity of electricity with which the sheet bundle is charged. Therefore, the insufficiently falling sheet bundle is hooked by the bundle hook 21*a* as shown in FIG. 10, causing sheet jam. Thus, in the first embodiment, the finisher 1 is provided with a push-out lever which pushes out the insufficiently falling sheet bundle into the direction of the stack tray 23, interlocked with the operation of the bundle hook 21*a*.

Figure 11:
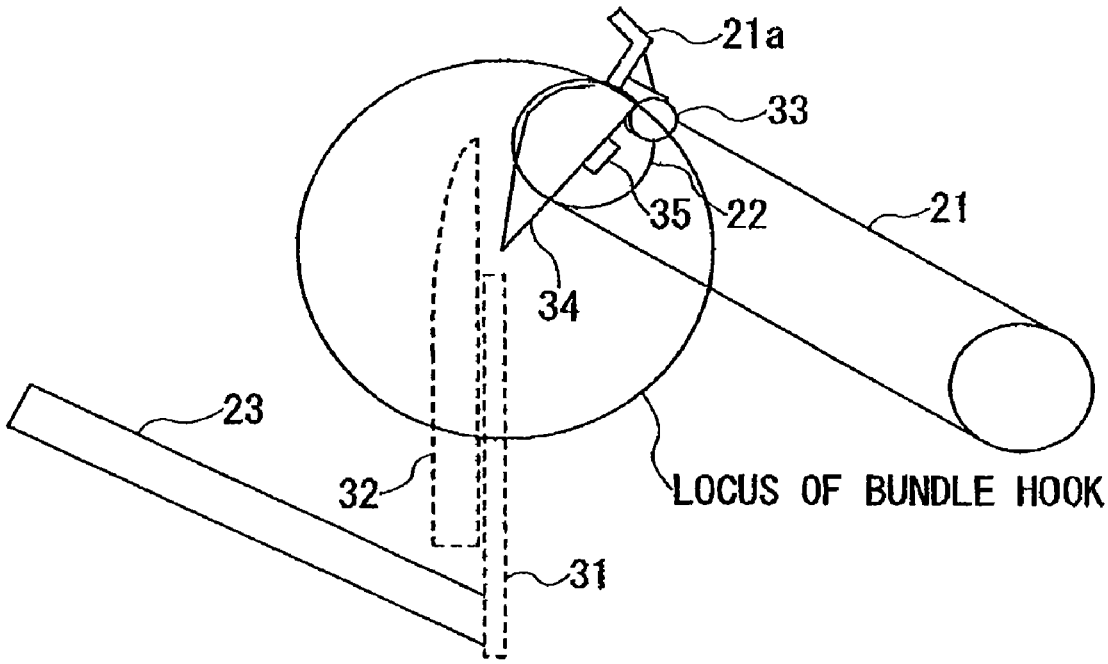
FIG. 11 is a sectional view showing a configuration of a push-out lever provided on the finisher.
Figure 12:
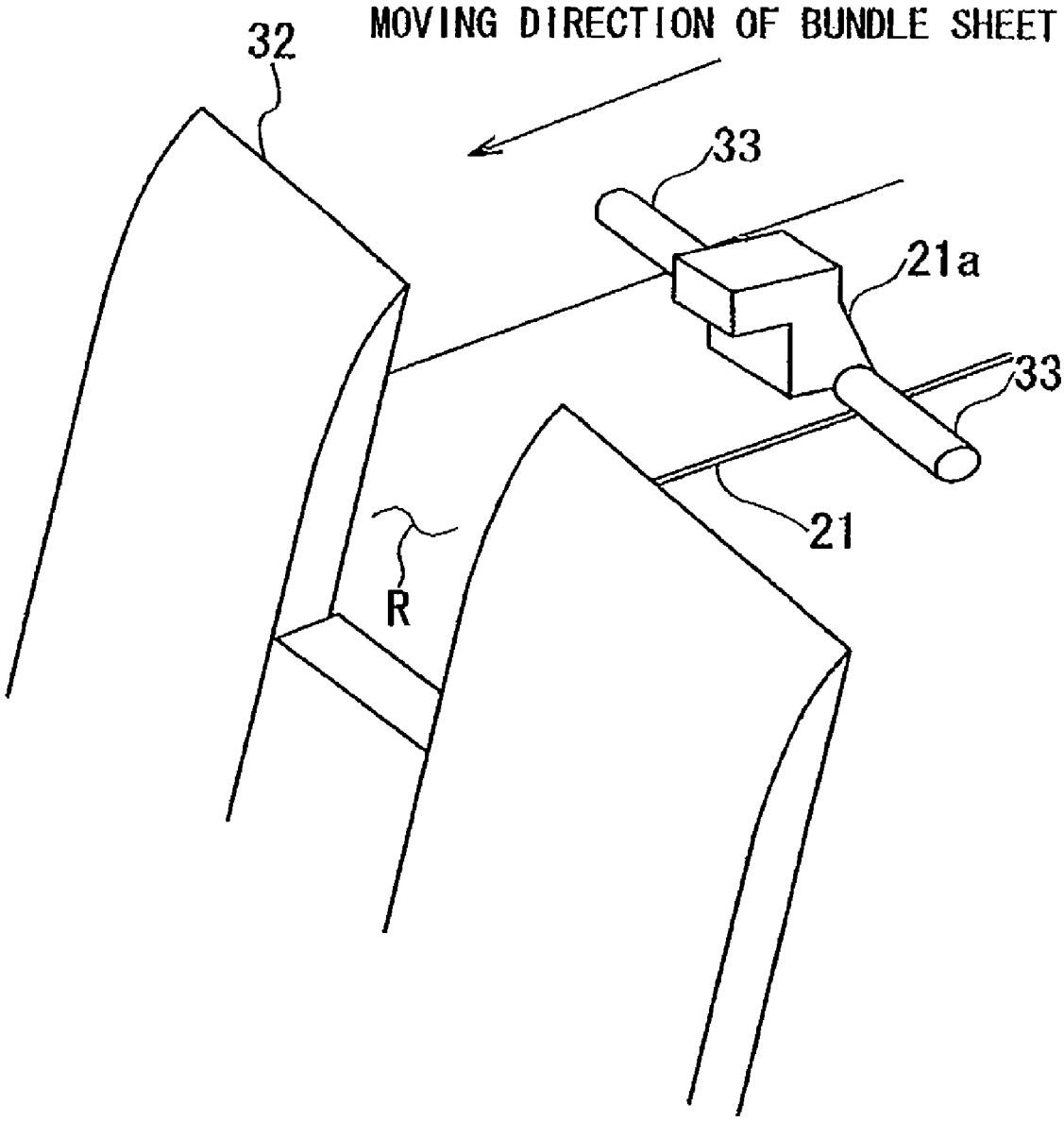
FIG. 12 is a perspective view of the bundle hook.

FIG. 11 is a sectional view showing a configuration of the push-out lever 34 provided in the finisher 1. As shown in FIG. 11, the push-out lever 34 is connected to the discharge roller 22 by an elastic member such as a spring or the like. The push-out lever 34 is fixed to the discharge roller 22 by a stopper 35. If the sheet bundle is discharged to the stack tray 23, interlocked with discharging by the discharge roller 22, the locus of the bundle hook 21*a* is as shown in FIG. 11. The push-out lever 34 has an opening on its one side. The bundle hook 21*a* is partly housed in the push-out lever 34 from the opening of the push-out lever 34 if discharging the sheet bundle. A shutter 32 is provided in the finisher 1 so that the sheet P does not enter the gap between a wall 31 of the stack tray 23 and the bundle hook belt 21, FIG. 12 is a perspective view of the bundle hook 21*a*. As shown in FIG. 12, push-out parts 33 for causing the push-out lever 34 to protrude into the direction of the stack tray 23 from an opening R of the shutter 32, interlocked with the operation of the bundle hook 21*a*, are provided on the bundle hook 21*a*.

Figure 13:
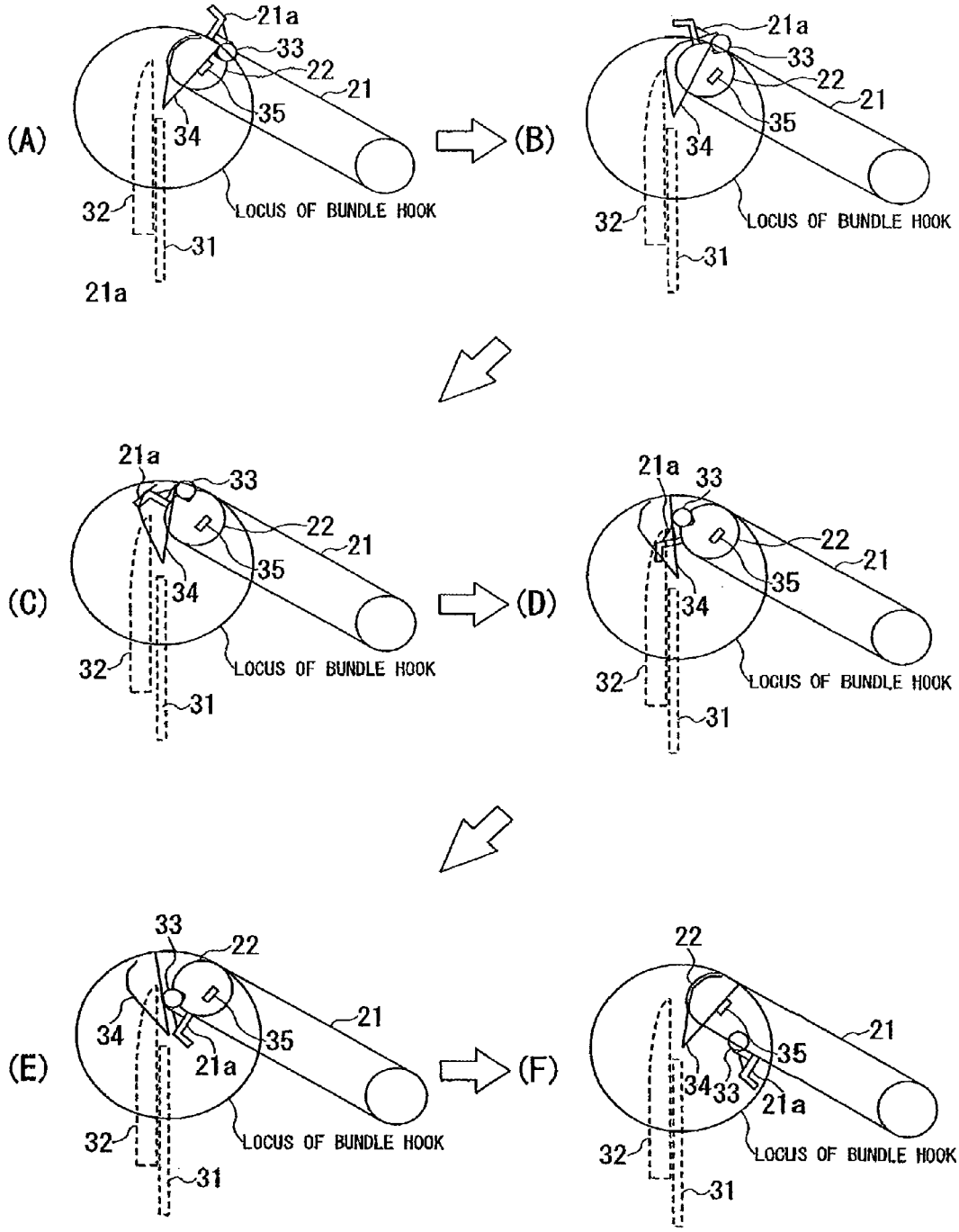
FIG. 13A to FIG. 13F show protrusion of the push-out lever when discharging a sheet bundle by using the bundle hook.

FIG. 13A to FIG. 13F show protrusion of the push-out lever 34 when discharging a sheet bundle by using the bundle hook 21*a*. As shown in FIG. 13A, the bundle hook 21*a* discharges the sheet bundle to the stack tray 23, interlocked with discharging by the discharge roller 21. If the bundle hook 21*a* reaches the rotation part M, the push-out parts 33 provided on the bundle part 21*a* start pushing out the push-out lever 34 together with rotation of the bundle hook 21*a*. As shown in FIG. 13B, the push-out parts 33 of the bundle hook 21*a* gradually push out the push-out lever 34 fixed to the discharge roller 22 by the stopper 35, in accordance with the rotation of the bundle hook 21*a*.

Figure 14:
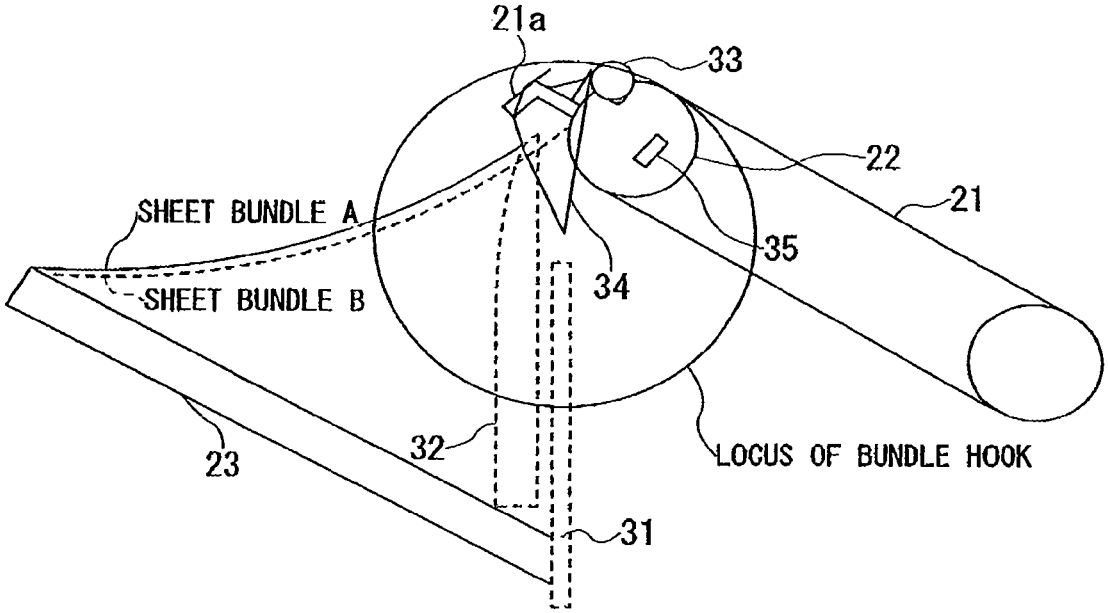
FIG. 14 shows pushing out of a sheet bundle by the push-out lever.

As shown in FIG. 13C, the push-out parts 33 of the bundle hook 21*a* cause the push-out lever 34 to protrude from the opening R of the shutter 32 into the direction of the stack tray 23 in accordance with the rotation of the bundle hook 21*a*. FIG. 14 shows push-out operation of a sheet bundle by the push-out lever 34. As shown in FIG. 14, if the push-out lever 34 is provided in the finisher 1, the push-out lever 34 protruding from the opening R of the shutter 32 pushes out the rear end of a sheet bundle A to the stack tray 23. Thus, the insufficiently falling sheet bundle can be prevented from being hooked by the bundle hook 21*a* and occurrence of sheet jam can be prevented. Meanwhile, if the push-out lever 34 is not provided in the finisher 1, the rear end of a sheet bundle B does not properly fall into the stack tray 23 and the insufficiently falling sheet bundle is hooked by the bundle hook 21*a*, causing sheet jam. In the case of FIG. 13C, the bundle hook 21*a* starts to be partly housed within the push-out lever 34 from the opening of the push-out lever 34.

As shown in FIG. 13D and FIG. 13F, the push-out lever 34 causes the push-out lever 34 to protrude from the opening R of the shutter 32 into the direction of the stack tray 23 in accordance with the rotation of the bundle hook 21*a*. After that, as shown in FIG. 13F, if the rotation of the bundle hook 21*a* ends, the push-out lever 34 returns into the direction of the discharge roller 22 by the tensile force of the spring and returns to a default position.

In the first embodiment, the nipping pawl (bundle hook 21*a*) to nip a sheet bundle is provided. The sheet bundle is conveyed while being nipped by the nipping pawl. The carried sheet bundle is sequentially discharged. The carried sheet bundle is stacked. The opening R is provided on one side of the shutter 32 provided between the discharge roller 22 and the stack tray 23, and the push-out parts 33 which cause the push-out lever 34 to protrude from the opening R of the shutter 32 toward the stack tray 23, with the rotation of the nipping pawl, are provided on the nipping pawl. The push-out lever 34 caused to protrude to the stack tray 23 by the push-out parts 33 can push out the sheet bundle to the stack tray 23 in accordance with the rotation of the nipping pawl. Thus, the bundle hook 21*a* can return to its initial home position without catching a sheet or sheet bundle and can prevent sheet jam. Therefore, sheet jam at the time of discharging a sheet or sheet bundle by using the bundle hook can be properly prevented.

Second Embodiment

In the conventional finisher, after sheets are aligned in the processing tray 14, the bundle hook belt 21 is turned by driving of the bundle hook motor as a stepping motor. The bundle hook 21*a* provided on the bundle hook belt 21 hooks a sheet bundle and discharges the sheet bundle to the stack tray 23, interlocked with discharging by the discharge roller 22. However, in the conventional finisher, the current value of the bundle hook motor driving the bundle hook belt 21 is the same value in sorting and in stapling. Moreover, in both sorting and stapling, the current value of the bundle hook motor is the same value all the time from the start of driving of the bundle hook belt 21 until the driving is stopped. Therefore, the bundle hook belt 21 is driven with an excessive torque and power consumption in driving the bundle hook belt 21 is increased. Thus, different values are set in advance as the current value of the bundle hook motor in sorting and the current value of the bundle hook motor in stapling. Moreover, the current value is changed in accordance with the load applied to the bundle hook motor during the driving of the bundle hook belt 21. Thus, the bundle hook belt 21 can be prevented from being driven with an excessive torque and power consumption in driving the bundle hook belt 21 can be reduced. Hereinafter, bundle hook belt driving control using this method will be described.

Figure 15:
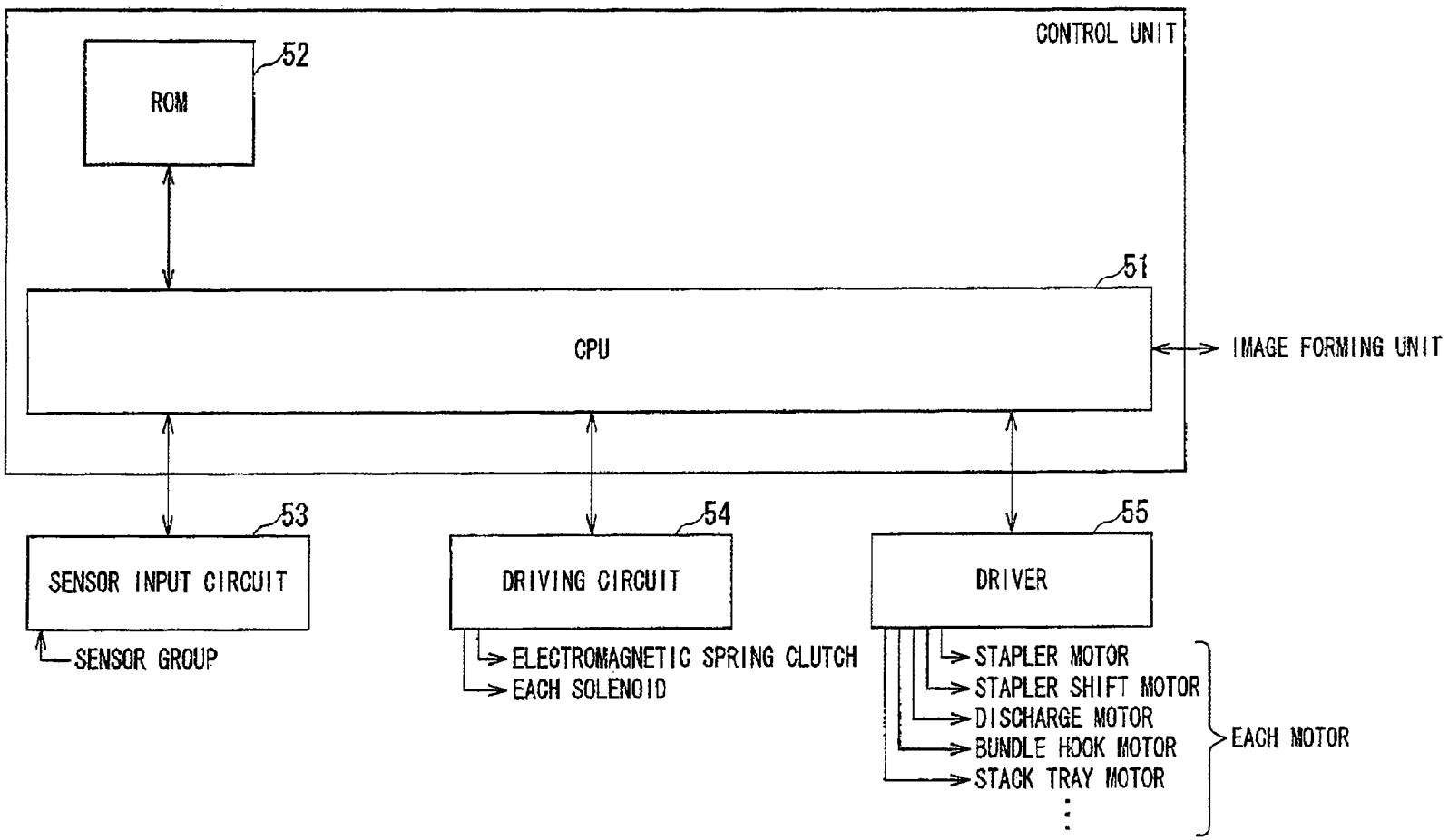
FIG. 15 is a block diagram showing a schematic internal configuration of a control system of a finisher according to a second embodiment.

FIG. 15 shows a schematic internal configuration of the control system of the finisher 1 according to the second embodiment. The second embodiment employs the same configuration shown in FIG. 1 to FIG. 9A and FIG. 9B and repeated explanation of this configuration will not be given. As shown in FIG. 15, the control system of the finisher 1 includes a CPU (central processing unit) 51, a ROM (read only memory) 52, a sensor input circuit 53, a driving circuit 54, and a driver 55. The CPU 51 executes various processing in accordance with various application programs stored in the ROM 52. The CPU 51 also generates various control signals and supplies the control signals to each unit, thereby controlling the finisher 1 in an integrated manner. The ROM 52 stores data that are necessary for the CPU 51 to execute various processing. The sensor input circuit 53 supplies inputs from a sensor group including, for example, an entry sensor and a staple home position sensor, to the CPU 51. The driving circuit 54 switches on and off the electromagnetic spring clutch in order to transmit the driving force of the bundle hook motor to the ejector 20 under the control of the CPU 51. The driving circuit 54 also drives each solenoid in accordance with the control of the CPU 51. The driver 55 drives each motor under the control of the CPU 51.

In the case of sorting, the number of sheets that are aligned in the processing tray 14 and discharged to the stack tray 23 is approximately one to four. On the other hand, in the case of stapling, the number of sheets that are aligned in the processing tray 14 and discharged to the stack tray 23 is approximately two to fifty. Here, the loading state of the bundle hook motor driving the bundle hook belt 21 is divided into three states "heavy", "moderate" and "light". The current value of the bundle hook motor is set at such a value that no trouble occurs in the operation in each loading state. If the loading state is "heavy", it is assumed that the bundle hook 21*a* and the ejector 20 having the eject arm are simultaneously driven at the time of stapling a greater number of sheets than a predetermined number of sheets (for example, 10 sheets). If the loading state is "moderate", it is assumed that the bundle hook 21*a* is driven after the release of the ejector 20 in stapling a predetermined number of sheets or less. If the loading state is "light", it is assumed that the bundle hook 21*a* is kept still at the home position.

Figure 16:
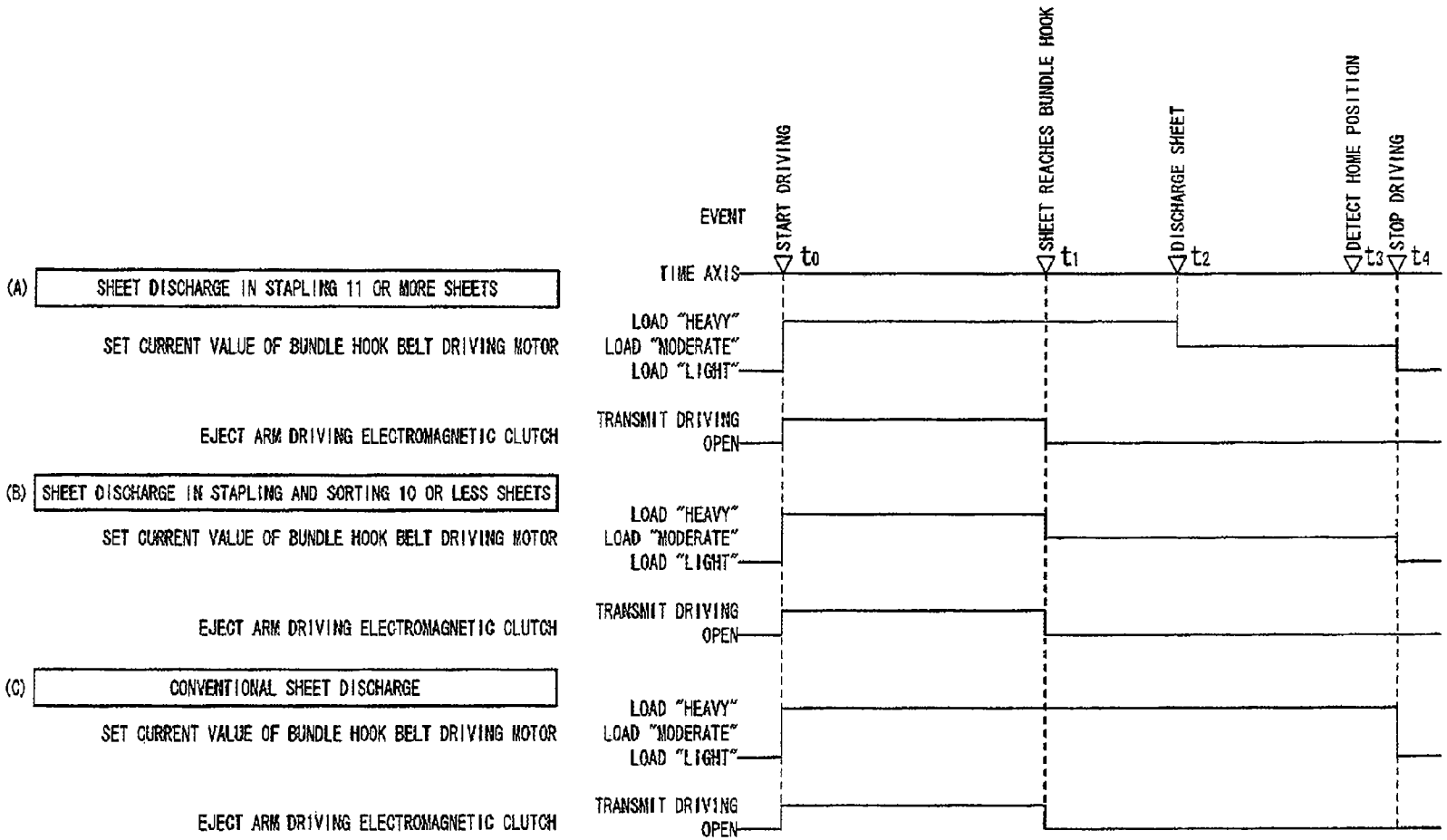
FIG. 16A to FIG. 16C are timing charts showing switching of a set value of current value of a bundle hook motor and on-off switching of an electromagnetic spring clutch for an ejector.

Conventionally, the current value of the bundle hook motor driving the bundle hook belt 21 is the same value in sorting and in stapling. Moreover, in both sorting and stapling, the current value of the bundle hook motor is the same value all the time from the start of driving of the bundle hook belt 21 until the driving is stopped. Therefore, the bundle hook belt 21 is driven with an excessive torque and power consumption in driving the bundle hook belt 21 is increased. Conventionally, the current value of the bundle hook motor in both sorting and stapling is such a current value that the loading state of the bundle hook motor is set to "heavy", all the time from the start of driving of the bundle hook belt 21 until the driving is stopped, as shown in FIG. 16C. Therefore, the bundle hook belt 21 is driven with an excessive torque and power consumption in driving the bundle hook belt 21 is increased.

Figure 17:
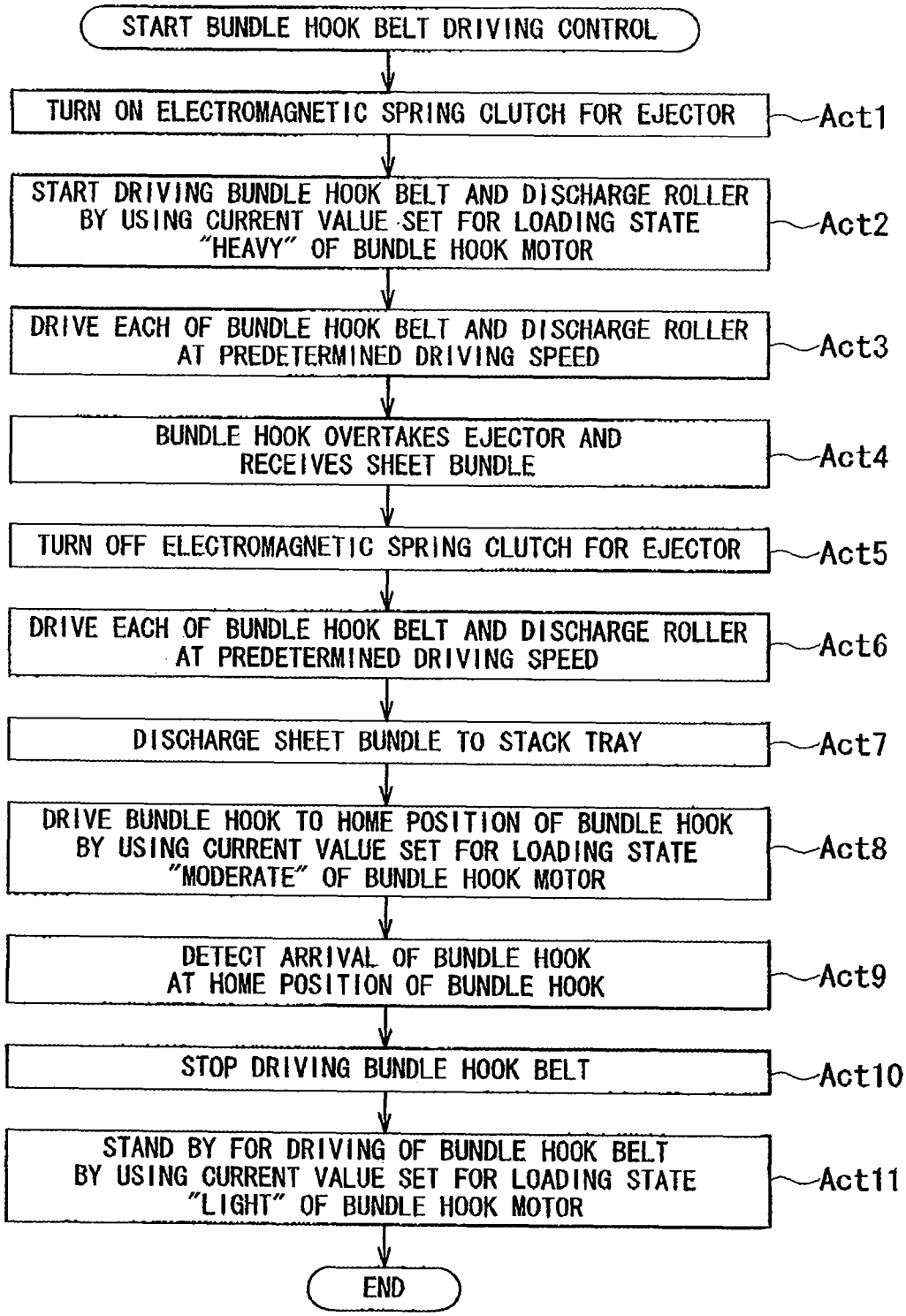
FIG. 17 is a flowchart for explaining bundle hook belt driving control in the finisher shown in FIG. 15.

Bundle hook belt driving control in the finisher 1 shown in FIG. 15 will be described with reference to the flowchart of FIG. 17. In the case of FIG. 17, bundle hook belt driving control in stapling a sheet bundle having a greater number of sheets than a predetermined number of sheets (for example, 10 sheets) will be described. FIG. 16A is a timing chart in executing the bundle hook belt driving control shown in FIG. 17.

In Act 1, if binding of a sheet bundle by the stapler 19 is completed, the CPU 51 controls the driving circuit 54 and the driver 55 to turn on the electromagnetic spring clutch at time to. In Act 2, the CPU 51 controls the driving circuit 54 and the driver 55 to start driving the bundle hook motor and the discharge motor in the state where the electromagnetic spring clutch is on, by using a current value set for the loading state "heavy" of the bundle hook motor. Thus, in the finisher 1, the bundle hook belt 21, the discharge roller 22 and the ejector 20 start to be driven by using the current value set for the loading state "heavy" of the bundle hook motor.

In Act 3, the CPU 51 controls the driver 55 to drive the bundle hook belt 21 and the discharge roller 22 at each driving speed. Particularly, the bundle hook belt 21 and the discharge roller 22 are driven at each driving speed at least while the bundle hook belt 21 starts being driven from the home position and rotates as shown in FIG. 9A and FIG. 9B and on the straight path after the rotation. In Act 4, the bundle hook 21*a* on the bundle hook belt 21 is driven in accordance with the control of the CPU 51 and reaches the straight path after the rotation. The bundle hook 21*a* on the bundle hook belt 21 overtakes the ejector 20 at time $t_1$ and receives the sheet bundle from the ejector 20. In Act 5, the CPU 51 controls the driving circuit 54 and the driver 55 to turn off the electromagnetic spring clutch after the ejector 20 receives the sheet bundle. Thus, the driving force of the bundle hook motor is not transmitted to the ejector 20.

In Act 6, the CPU 51 controls the driver 55 to gradually accelerate the bundle hook belt 21 and the discharge roller 22 after the bundle hook belt 21 receives the sheets. The CPU 51 then drives the bundle hook belt 21 and the discharge roller 22 at each driving speed. To synchronize driving of the bundle hook belt 21 and the discharge roller 22, it is preferable to set the driving speed of the bundle hook belt 21 and the driving speed of the discharge roller 22 to the same speed. In Act 7, the CPU 51 controls the driver 55 to discharge the sheet bundle to the stack tray 23 at time $t_2$ by using the bundle hook 21*a* on the bundle hook belt 21 and the discharge roller 22. In Act 8, the CPU 51 controls the driver 55 to drive the bundle hook motor by using the current value set for the loading state "moderate" of the bundle hook motor, and to drive the bundle hook 21*a* on the bundle hook belt 21 to the home position of the bundle hook 21*a*. In Act 9, the sensor provided near the home position of the bundle hook 21*a* detects the arrival of the bundle hook 21*a* at the home position of the bundle hook 21*a* at time $t_3$. In Act 10, the CPU 51 controls the driver 55 to stop driving the bundle hook motor and stops driving the bundle hook belt 21. In Act 11, after the driving of the bundle hook belt 21 is stopped, the CPU 51 controls the driver 55 to stand by for driving of the bundle hook belt 21 by using the current value set for the loading state "light" of the bundle hook motor.

Thus, in the case of FIG. 16A, power consumed during the period from time $t_2$ when the sheets (sheet bundle) are discharged, to time $t_4$ when driving of the bundle hook belt 21 is stopped, can be reduced, compared to the conventional sheet discharge shown in FIG. 16C. At the same time, the bundle hook motor can be driven in such a manner that no trouble occurs in the operation in each loading state.

Figure 18:
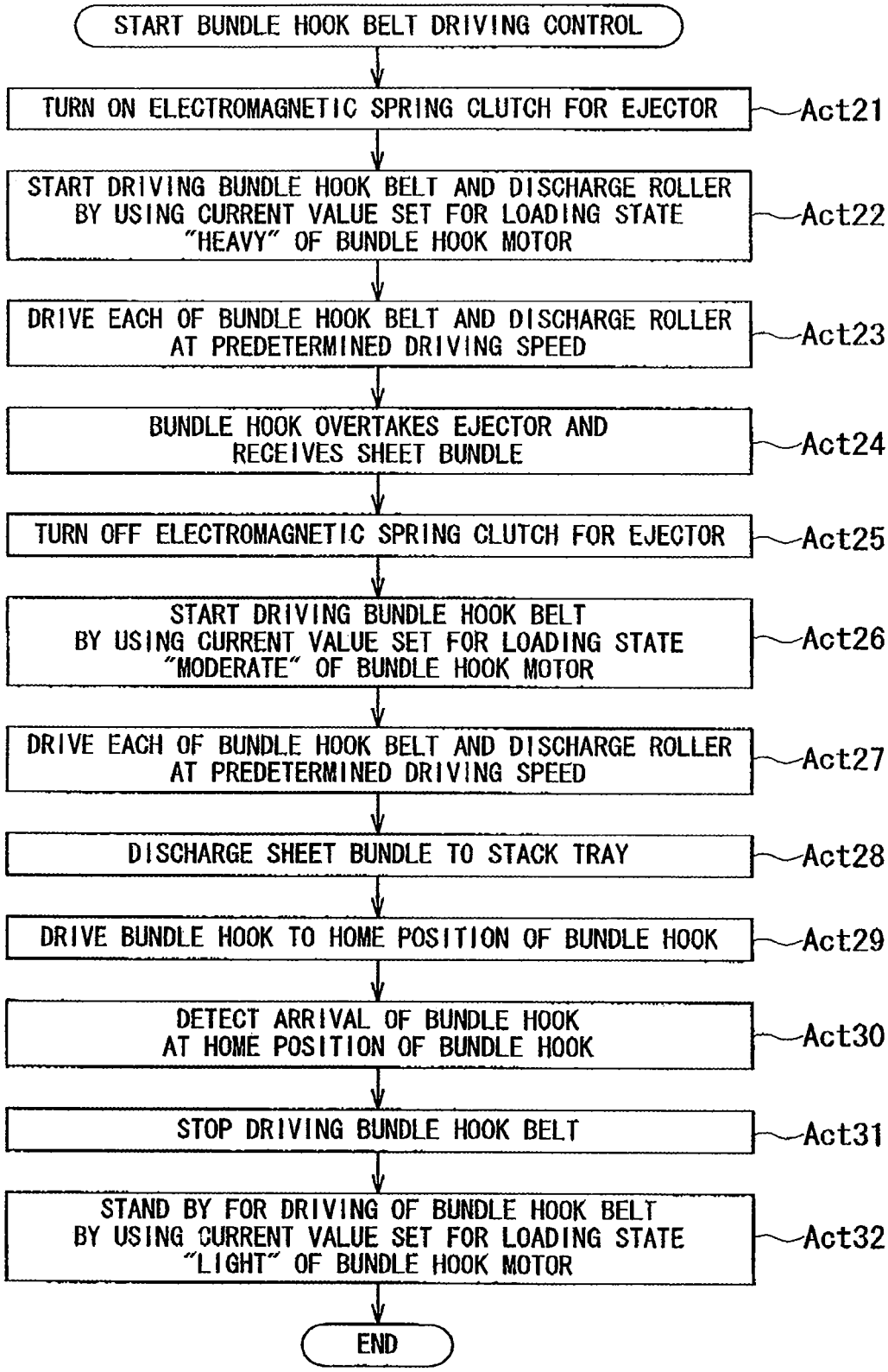
FIG. 18 is a flowchart for explaining another bundle hook belt driving control in the finisher shown in FIG. 15.

Now, another bundle hook belt driving control in the finisher 1 shown in FIG. 15 will be described with reference to the flowchart of FIG. 18. In the case of FIG. 18, bundle hook belt driving control in stapling or sorting a sheet bundle having a predetermined number of sheets (for example, 10 sheets) or less will be described. FIG. 16B is a timing chart in executing the bundle hook belt driving control shown in FIG. 18. Acts 21 to 32 in FIG. 18 are fundamentally similar to Acts 1 to 11 in FIG. 17, except in that timing of switching the current value of the bundle hook motor for driving the bundle hook belt is different. Therefore, only the difference will be described while the description of each act in FIG. 18 is omitted.

In the case of FIG. 17, in the finisher 1, after the sheet bundle is discharged to the stack tray 23, the current set for the loading state "heavy" of the bundle hook motor is switched to the current value set for the loading state "moderate" of the bundle hook motor, and driving of the bundle hook belt is started by using the current value set for the loading state "moderate" of the bundle hook motor, thus driving the bundle hook 21*a* to the home position of the bundle hook 21*a*, as shown in FIG. 16A. On the other hand, in the case of FIG. 18, in the finisher 1, after the bundle hook 21*a* receives the sheet bundle, the current value set for the loading state "heavy" of the bundle hook motor is switched to the current value set for the loading state "moderate" of the bundle hook motor, and driving of the bundle hook belt is started by using the current value set for the loading state "moderate" of the bundle hook motor, as shown in FIG. 16B.

Thus, in the case of FIG. 16B, power consumed during the period from time $t_1$ when the bundle hook 21*a* receives the sheet, to time $t_4$ when driving of the bundle hook belt 21 is stopped, can be reduced, compared to the conventional sheet discharge shown in FIG. 16C. Therefore, compared to the case of FIG. 16A, power consumed during the period from time $t_1$ to time $t_2$ can be reduced further.

The loading state of the bundle hook motor may be divided with higher definition and the current value may be set with higher definition for each loading state of the bundle hook motor. This enables further reduction in power consumption due to driving of the bundle hook motor while driving the bundle hook motor in such a manner that no trouble occurs in the operation in each loading state.

Third Embodiment

In the conventional finisher 1, stapled or sorted sheets (sheet bundle) are discharged to the stack tray 23 by the bundle hook 21*a*. This stack tray 23 is a tray that can be moved by a stack tray motor. The stack tray 23 can move up and down along the wall 31 of the stack tray 23, as shown in FIG. 3 and FIG. 4. Therefore, depending on the discharging state of sheets or a sheet bundle to the stack tray 23, the finisher 1 cannot accurately discharge the sheets or sheet bundle, causing misalignment. The fall and rise of the stack tray 23 is fundamentally synchronous with the sheet discharge. However, the falling time of the stack tray 23 is set in accordance with the state of sheets loaded on the movable stack tray 23 or the state of sheets in discharge. Therefore, if the fall and rise cycle of the stack tray 23 cannot be synchronized with the sheet discharge cycle, misalignment occurs.

Thus, if the stack tray 23 is driven when starting discharge of sheets or a sheet bundle, timing of discharging sheets or a sheet bundle that follows the currently discharged sheets or sheet bundle from the image forming unit is delayed by a predetermined time. Hereinafter, bundle hook motor driving control using this method will be described. The internal configuration of the control system of the finisher 1 according to the third embodiment is similar to the configuration shown in FIG. 15 and therefore its description will not be repeated. Also in the third embodiment, the configuration shown in FIG. 1 to FIG. 9A and FIG. 9B is the same and its description will not be repeated.

Figure 19:
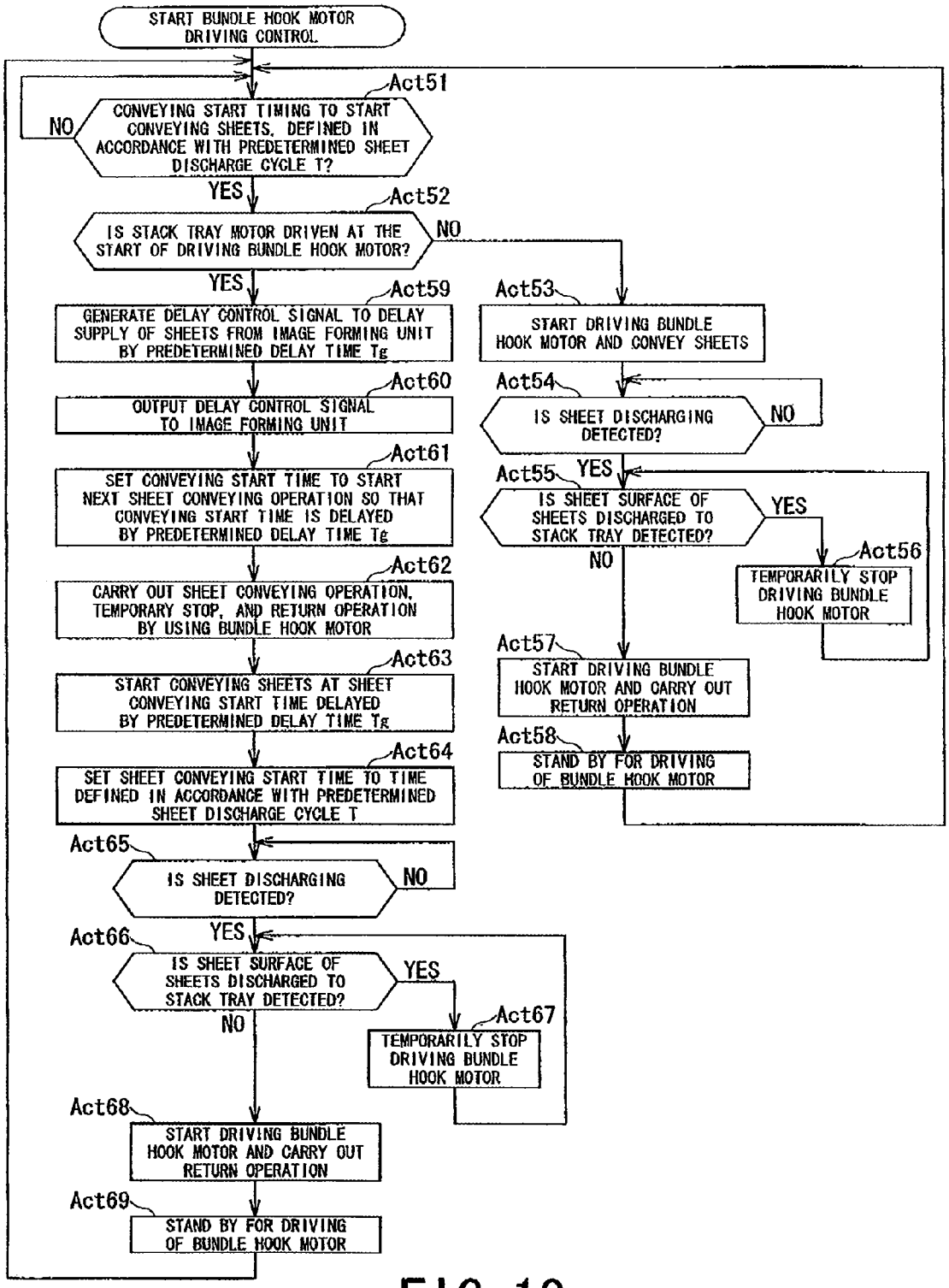
FIG. 19 is a flowchart for explaining bundle hook motor driving control in the finisher shown in FIG. 15.
Figure 20:
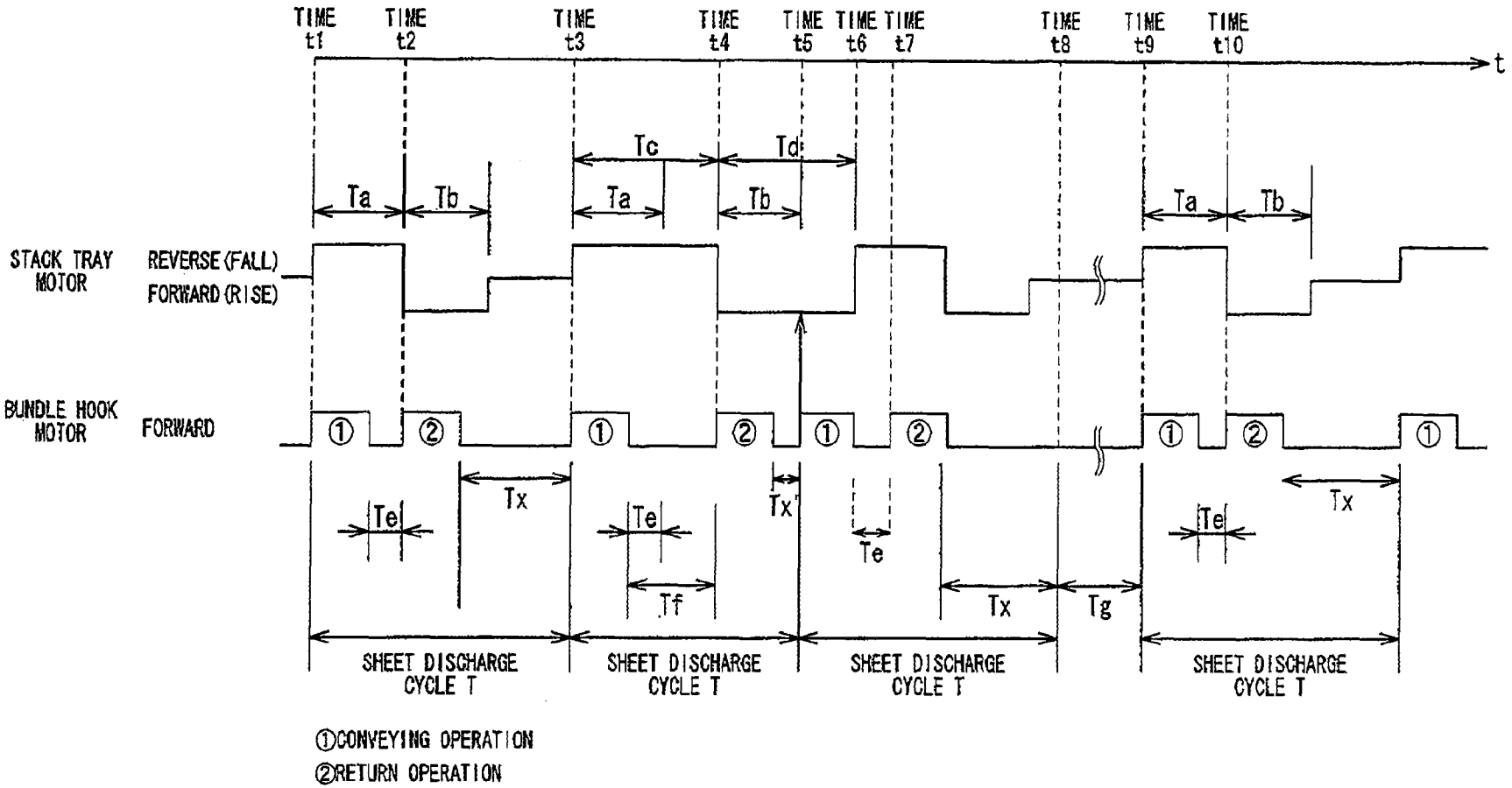
FIG. 20 is a timing chart showing operations of a bundle hook motor and a stack tray motor.

The bundle hook motor driving control in the finisher 1 shown in FIG. 15 will be described with reference to the flowchart of FIG. 19. FIG. 20 is a timing chart with respect to the operations of the bundle hook motor and the stack tray motor. The sheet discharge operation using the bundle hook belt 21 and the bundle hook 21*a* includes a sheet conveying operation, a temporary stop operation, and a return operation, as shown in FIG. 20. A sheet surface detecting sensor which detects a sheet surface of the sheet discharged to the stack tray 23 by the sheet discharge operation is provided near the rotation part M where the bundle pawl 21*a* rotates and the discharge roller 22. If the sheet surface detecting sensor detects the sheet surface of the sheet discharged to the stack tray 23, the CPU 51 of the finisher 1 recognizes that the sheet is discharged to the stack tray 23 in bad condition. On the other hand, if the sheet surface detecting sensor does not detect the sheet surface of the sheet discharged to the stack tray 23, the CPU 51 of the finisher 1 recognizes that the sheet is discharged to the stack tray 23 in good condition. Furthermore, a discharging sensor which detects a sheet discharging is provided on the processing tray 14. The discharging sensor detects the sheet discharging by detecting that the sheet is conveyed in accordance with the sheet discharge operation.

In Act 51, the CPU 51 determines, by using a timer, whether it is the timing of starting the sheet conveying operation defined by a sheet discharge cycle T or not. The CPU 51 waits until it is determined that it is the timing of starting the sheet conveying operation defined by the sheet discharge cycle T. If the CPU 51 determines in Act 51 that it is the timing of starting the sheet conveying operation defined by the sheet discharge cycle T, the CPU 51 determines in Act 52 whether the stack tray motor which drives the stack tray 23 when starting to drive the bundle hook motor is driven or not. Specifically, if the driving start time of the bundle hook motor is time $t_1$, the CPU 51 determines that the stack tray motor which drives the stack tray 23 when starting to drive the bundle hook motor is not driven.

If the CPU 51 determines in Act 52 that the stack tray motor which drives the stack tray 23 when starting to drive the bundle hook motor is not driven, the CPU 51, in Act 53, controls the driver 55 to start driving the bundle hook motor, thus conveying the sheets. For example, in the finisher 1, at time $t_1$, driving of the bundle hook motor is started and the sheets are conveyed. At this time, the fall of the stack tray 23 by the stack tray motor starts while being synchronous with the sheet discharge. After that, in Act 54, the CPU 51 determines whether the sheet discharging is detected by the discharging sensor provide on the processing tray 14 or not. The CPU 51 waits until the sheet discharging is detected by the discharging sensor. If the CPU 51 determines in Act 54 that discharging is detected by the discharging sensor provide on the processing tray 14, the CPU 51 determines in Act 55 whether the sheet surface of the sheet discharged to the stack tray 23 by the sheet discharge operation is detected by the sheet surface detecting sensor or not. If the CPU 51 determines in Act 55 that the sheet surface of the sheet discharged to the stack tray 23 by the sheet discharge operation is detected by the sheet surface detecting sensor, the CPU 51 recognizes that the sheet is discharged to the stack tray 23 in bad condition, and in Act 56, the CPU 51 controls the driver 55 to temporarily stop driving the bundle hook motor. After that the processing returns to Act 55. Thus, temporary stop of driving of the bundle hook motor is maintained until the sheet surface of the sheets discharged to the stack tray 23 is detected by the discharging sensor. At this time, as shown in FIG. 20, the stack tray 23 continues to fall until the sheet surface of the sheets discharged to the stack tray 23 is detected by the sheet surface detecting sensor. On the other hand, if the CPU 51 determines in Act 55 that the sheet surface of the sheet is detected by the sheet surface detecting sensor, the CPU 51 recognizes that the sheet is discharged to the stack tray 23 in good condition. The CPU 51 controls the driver 55 to restart driving the bundle hook motor, and to return the bundle hook 21*a*. After that, in Act 58, the CPU 51 controls the driver 55 to stand by for driving of the bundle hook motor. In the case of FIG. 20, for example, the finisher 1 starts the sheet conveying operation at time $t_1$ and carries out the conveying operation. Then, the finisher 1 temporarily stops driving the bundle hook motor for a temporary stop time Te until the sheet surface is detected by the sheet surface detecting sensor after the sheet conveying operation stops. The finisher 1 starts the return operation of the bundle hook 21*a* at time $t_2$ and carries out the return operation. At this time, the rise of the stack tray 23 by the stack tray motor starts while being synchronous with the return operation of the bundle hook 21*a* After that, the finisher 1 controls the driver 55 to stand by for driving of the bundle hook motor for a standby time Tx.

After that, the processing returns to Act 51.

Next, the finisher 1 executes Acts 51 to 58, starts the sheet conveying operation, for example, at time $t_3$ and carries out the conveying operation, as shown in FIG. 20. However, depending on the discharging state of the sheets or sheet bundle to the stack tray 23, the finisher 1 cannot accurately discharge the sheets or sheet bundle, causing misalignment. If so, the sheet surface of the sheet discharged to the stack tray 23 continues to be detected by the sheet surface detecting sensor. Therefore, the temporary stop time Te of the bundle hook motor is extended to Tf together with the falling time Ta of the stack tray 23 extended to the Tc. After that, the finisher 1 starts the return operation of the bundle hook 21*a* at time $t_4$ and carries out the return operation. Therefore, the standby time Tx of the bundle hook motor is reduced to Tx'. However, since the rising time Tb of the stack tray 23 is extended to Td along with the extension of the falling time, the timing of the sheet discharge by the bundle hook motor and the timing of the fall and rise of the stack tray 23 become different from each other. In the case of FIG. 20, the time to start the sheet conveying operation by the bundle hook motor is time $t_5$ defined in accordance with the sheet discharge cycle T, whereas the time to start the fall of the stack tray 23 is time $t_6$. In such a case, in the bundle hook motor driving control shown in FIG. 19, the CPU 51 determines in Act 52 that the stack tray motor which drives the stack tray 23 when starting to drive the bundle hook motor is driven at time $t_5$. Then, in Act 59, the CPU 51 generates a delay control signal that delays the supply of the sheets from the image forming unit by a predetermined delay time Tg. In Act 60, the CPU 51 outputs the generated delay control signal to the image forming unit.

In Act 61, the CPU 51 sets the time to start the sheet conveying operation by the bundle hook motor so that this starting time is delayed by the predetermined delay time Tg from the time defined by the sheet discharge cycle T. In the case of FIG. 20, the CPU 51 set the time to start the sheet conveying operation by the bundle hook motor to time $t_9$, which is delayed by the predetermined delay time Tg from time $t_8$ defined by the sheet discharge cycle T. In other words, the predetermined delay time Tg is added to the standby time Tx of the bundle hook motor. In Act 62, the CPU 51 controls the driver 55 to carry out the sheet conveying operation, the temporary stop and the return operation by using the bundle hook motor, irrespective of the timing of the fall and rise of the stack tray 23. In Act 63, the CPU 51 controls the driver 55 to start the sheet conveying operation at the starting time of the sheet conveying operation which is delayed by the predetermined delay time Tg. In the case of FIG. 20, the CPU 51 starts the sheet conveying operation at the starting time $t_9$ of the sheet conveying operation which is delayed by the predetermined delay time Tg. At this time, the CPU 51 controls the driver 55 to start the fall of the stack tray 23 synchronously with the sheet conveying operation.

In Act 64, the CPU 51 sets the starting time of the sheet conveying operation by the bundle hook motor to a time defined in accordance with the sheet discharge cycle T. In Act 65, the CPU 51 determines whether the sheet discharging is detected by the discharging sensor provide on the processing tray 14 or not. The CPU 51 waits until the sheet discharging is detected by the discharging sensor. If the CPU 51 determines in Act 65 that discharging is detected by the discharging sensor provide on the processing tray 14, the CPU 51 determines in Act 66 whether the sheet surface of the sheet discharged to the stack tray 23 by the sheet discharge operation is detected by the sheet surface detecting sensor or not. If the CPU 51 determines in Act 66 that the sheet surface of the sheet discharged to the stack tray 23 by the sheet discharge operation is detected by the sheet surface detecting sensor, the CPU 51 recognizes that the sheet is discharged to the stack tray 23 in bad condition, and in Act 67, the CPU 51 controls the driver 55 to temporarily stop driving the bundle hook motor. After that the processing returns to Act 66.

On the other hand, if the CPU 51 determines in Act 66 that the sheet surface of the sheet is detected by the sheet surface detecting sensor, the CPU 51 recognizes that the sheet is discharged to the stack tray 23 in good condition. In Act 68, the CPU 51 controls the driver 55 to restart driving the bundle hook motor, and to return the bundle hook 21*a*. After that, in Act 69, the CPU 51 controls the driver 55 to stand by for driving of the bundle hook motor. In the case of FIG. 20, for example, the finisher 1 starts the sheet conveying operation at time $t_9$ and carries out the conveying operation. Then, the finisher 1 temporarily stops driving the bundle hook motor for a temporary stop time Te until the sheet surface is detected by the sheet surface detecting sensor after the sheet conveying operation stops. The finisher 1 starts the return operation of the bundle hook 21*a* at time $t_{10}$ and carries out the return operation. At this time, the rise of the stack tray 23 by the stack tray motor starts while being synchronous with the return operation of the bundle hook 21*a* After that, the finisher 1 controls the driver 55 to stand by for driving of the bundle hook motor for a standby time TX. Then, the processing returns to Act 51. Thus, even if the cycle of the fall and rise of the stack tray 23 cannot be synchronized with the cycle of the sheet discharge and therefore misalignment occurs, the predetermined delay time Tg can be added to the standby time Tx, thereby solving the synchronization error of the two operation cycles.

The predetermined delay time Tg added to the standby time Tx may be uniformly set to be a time taken for the stack tray 23 to rise or fall by a distance equal to half the length of the maximum sheet that can be processed by the finisher 1, irrespective of the misalignment state. Alternatively, the predetermined delay time Tg may be set to be a time taken for the stack tray 23 to rise or fall by a distance equal to half the length of the sheets discharged at time $t_5$ in FIG. 20 which already have misalignment. Moreover, the predetermined delay time Tg may be set to be a time equivalent to the delay in synchronization caused by misalignment (that is, in the case of FIG. 20, time equivalent to the difference between Td and Tb).

The series of processing described herein can be executed in the form of software or by hardware.

The acts in the flowcharts need not be carried out in time series and may include processing that is executed in parallel or individually.

What is claimed is:

1. A finisher comprising:

a conveying unit having a hook to nip a sheet bundle configured to convey the sheet bundle while hooking the sheet bundle with the hook;

a discharge unit configured to sequentially discharge the sheet bundle conveyed by the conveying unit;

a stack unit configured to stack the sheet bundle conveyed by the conveying unit;

a shutter having an opening provided on one side of the shutter configured to be provided between the discharge unit and the stack unit;

a push-out lever fixed to the discharge unit configured to push-out the sheet bundle to the sheet unit; and a push-out part provided on the nipping hook configured to protrude the push-out lever to the stack unit from the opening of the shutter, with a rotation of the hook.

2. The finisher according to claim 1, wherein the push-out lever has a cup-like shape with an opening on its one side, and if the push-out part protrudes the push-out lever to the stack unit, at least a part of the hook is housed in the push-out lever.

3. The finisher according to claim 1, wherein the hook nips the sheet bundle.

4. A sheet discharging method for a finisher including: a conveying unit having a hook to nip a sheet bundle which conveys the sheet bundle while hooking the sheet bundle; a discharge unit which sequentially discharges the sheet bundle conveyed by the conveying unit; a stack unit which stacks the sheet bundle conveyed by the conveying unit; a shutter provided between the discharge unit and the stack unit; a push-out lever fixed to the discharge unit; and a push-out part provided on the hook which protrudes the push-out lever to the stack unit from an opening of the shutter with a rotation of the hook, the method comprising pushing out the sheet bundle to the stack unit by the push-out lever protruded to the stack unit by the push-out part in accordance with the rotation of the hook.

5. The sheet discharging method according to claim 4, wherein the hook nips the sheet bundle.

6. An image forming apparatus having a finisher, the finisher comprising:

a conveying unit having a hook to nip a sheet bundle configured to convey the sheet bundle while hooking the sheet bundle with the hook;

a discharge unit configured to sequentially discharge the sheet bundle conveyed by the conveying unit;

a stack unit configured to stack the sheet bundle conveyed by the conveying unit;

a shutter having an opening provided on one side of the shutter configured to be provided between the discharge unit and the stack unit;

a push-out lever fixed to the discharge unit configured to push out the sheet bundle to the sheet unit; and a push-out part provided on the hook configured to protrude the push-out lever to the stack unit from the opening of the shutter, with a rotation of the hook.

7. The image forming apparatus according to claim 6, wherein the push-out lever has a cup-like shape with an opening on its one side, and if the push-out part protrudes the push-out lever to the stack unit, at least a part of the hook is housed in the push-out lever.

8. The image forming apparatus according to claim 6, wherein the hook nips the sheet bundle.

* * * * *